US011352743B2

(12) United States Patent
Hunter et al.

(10) Patent No.: US 11,352,743 B2
(45) Date of Patent: Jun. 7, 2022

(54) SYNTHETIC FIBER ROPE

(71) Applicant: BRIDON INTERNATIONAL LIMITED, Doncaster (GB)

(72) Inventors: Timothy Hunter, Glasgow (GB); Pengzhu Wang, Doncaster (GB); Ian Sinsbury, North Lanarkshire (GB); Adam Jeays, Sheffield (GB); James Taylor, Glasgow (GB)

(73) Assignees: BRIDON-BEKAERT ROPES GROUP, Doncaster (GB); BRIDON INTERNATIONAL LIMITED, Doncaster (GB)

( * ) Notice: Subject to any disclaimer, the term of this patent is extended or adjusted under 35 U.S.C. 154(b) by 0 days.

(21) Appl. No.: 16/967,198

(22) PCT Filed: Mar. 22, 2019

(86) PCT No.: PCT/EP2019/057298
§ 371 (c)(1),
(2) Date: Aug. 4, 2020

(87) PCT Pub. No.: WO2019/185487
PCT Pub. Date: Oct. 3, 2019

(65) Prior Publication Data

US 2020/0362511 A1 Nov. 19, 2020

(30) Foreign Application Priority Data

Mar. 26, 2018 (EP) ..... 18250010

(51) Int. Cl.
*D07B 1/02* (2006.01)

(52) U.S. Cl.
CPC ..... *D07B 1/025* (2013.01); *D07B 2201/108* (2013.01); *D07B 2201/1036* (2013.01);
(Continued)

(58) Field of Classification Search
CPC ..... D07B 1/025; D07B 2201/1036; D07B 2201/108; D07B 2201/2036
See application file for complete search history.

(56) References Cited

U.S. PATENT DOCUMENTS 3,822,542 A * 7/1974 Naud ..... D07B 7/027 57/215
4,120,145 A * 10/1978 Chiappetta ..... D07B 1/0673 57/221

(Continued)

FOREIGN PATENT DOCUMENTS

DE 196 48 257 5/1998
EP 0 252 830 1/1988

(Continued)

OTHER PUBLICATIONS

International Search Report dated Jun. 12, 2019 in International (PCT) Application No. PCT/EP2019/057298.

*Primary Examiner* — Shaun R Hurley
(74) *Attorney, Agent, or Firm* — Wenderoth, Lind & Ponack, L.L.P.

(57) ABSTRACT

A synthetic fiber rope comprising:—a core, said core being a laid or braided synthetic fiber strand,—a polymer layer, said polymer layer covering said core,—a first layer, said first layer having at least six first synthetic fiber strands laid in a first direction surround said polymer layer, and—a second layer, said second layer having at least twelve second synthetic fiber strands laid in a second direction surround said first layer.

13 Claims, 2 Drawing Sheets

(52) U.S. Cl.
CPC ..... *D07B 2201/1096* (2013.01); *D07B 2201/2036* (2013.01); *D07B 2205/20* (2013.01)

(56) References Cited

U.S. PATENT DOCUMENTS

| | | | | | |
|---|---|---|---|---|---|
| 5,269,128 | A * | 12/1993 | Walton | D07B 1/0686 | 57/210 |
| 5,797,254 | A * | 8/1998 | Walton | D07B 1/0686 | 57/220 |
| 6,318,504 | B1 | 11/2001 | De Angelis | | |
| 6,412,264 | B1 * | 7/2002 | De Josez | B66B 7/06 | 57/217 |
| 2002/0028112 | A1 * | 3/2002 | Paulshus | D07B 1/142 | 405/224.2 |
| 2008/0028740 | A1 | 2/2008 | Ushijima | | |
| 2008/0096701 | A1 | 4/2008 | Wang | | |
| 2008/0124546 | A1 | 5/2008 | Yaniv et al. | | |
| 2012/0298403 | A1 * | 11/2012 | Johnson | H01B 5/105 | 174/130 |
| 2017/0328001 | A1 * | 11/2017 | Kirth | D07B 1/025 | |

FOREIGN PATENT DOCUMENTS

| | | |
|---|---|---|
| EP | 1 022 377 | 7/2000 |
| JP | 2898228 | 5/1999 |
| WO | 2012/162556 | 11/2012 |

* cited by examiner

SYNTHETIC FIBER ROPE

TECHNICAL FIELD

The invention relates in general to a rope construction and in particular to a synthetic fiber rope construction.

BACKGROUND ART

Existing synthetic fibre rope solutions for the applications in hoisting and pulling e.g. winches and cranes have generally utilised braided rope constructions partially or entirely made from high modulus polyethylene (HMPE). Due to strand cross-overs, followed by lower packing factors and lower radial stability, such constructions may have intrinsically inferior performance properties, e.g. lower strength and inferior fatigue life. The use of braided constructions has also tended to limit material choices to HMPE, liquid crystal polymer (LCP) or HMPE/LCP blends since the internal abrasion generated by the strand cross-over in braided constructions may not be optimal for aramid materials and lead to premature failure compared with a braided HMPE rope. To overcome radial stiffness issue, some braided rope designs have utilised non-load bearing central cores (e.g. continuous filament polyester bundles or extruded polyurethane) to the otherwise hollow braided constructions to improve radial stability. However, this addition is at the expense of global material fill factor.

Specialised construction of synthetic fiber ropes are desired for high fiber strength conversion efficiency and fatigue resistance.

DISCLOSURE OF INVENTION

It is a main object of the present invention to develop a synthetic fiber rope in particular suitable for critical applications, e.g. applications with high operating temperatures, high tensions (safety factors below 3), low bending radius and high duty cycles.

It is another object of the present invention to devise a synthetic fiber rope having considerably increased strength, increased resistance to fatigue and having increased radial stability.

According to a first aspect of the present invention, there is provided a synthetic fiber rope comprising a core, said core being a laid or braided synthetic fiber strand, a polymer layer, said polymer layer covering said core, a first layer, said first layer having at least six first synthetic fiber strands laid in a first direction surround said polymer layer, and a second layer, said second layer having at least twelve second synthetic fiber strands laid in a second direction surround said first layer.

Herein, "layer" is also referred as jacket, cover or coating in prior art. The core of the synthetic fiber rope may have an area in a range of 5 to 10% of the total net polymeric cross-section area of the synthetic fiber rope. Herein, "net polymeric cross-section area" is load bearing material area or polymeric material area. The core can be a laid rope similar in shape and function to an independent wire rope core (also known as an IWRC wire rope) in a steel wire rope. The core can also have a braided layer before the application of the covering polymer layer.

The core of the synthetic fiber rope is covered, e.g. by extrusion, by a polymer layer. The polymer layer may be extruded in either round or fluted formation or of a special profile, and manufactured from a variety of materials including polypropylene (PP), polyethylene (PE), PP/PE blends, nylon (polyamide), Hytrel® and Arnitel®. The thickness of the extruded polymer layer is preferably in the range of 0.1 to 5 mm. More preferably, the thickness is greater than 0.5 mm. The extruded polymer layer increases transverse rigidity and bending stiffness of the synthetic fiber rope and reduces rotation too.

The first layer can be formed of between 6 and 12, preferably from 6 to 9 strands laid around the core. The second layer can be formed of between 12 and 24, preferably from 16 to 24 strands laid around the first layer. The number of strands in the second layer is selected according to rope diameter to maximise a high area contact and minimize contact pressure. The first layer or the second layer may have a load bearing area in a range of 40 to 60% of the total load bearing cross section area of the synthetic fiber rope.

A lay direction indicates the direction in which the strands of the rope are laid around the center strand. "S" direction or "S-lay" means the outer strands are laid in left hand direction around the center strand. "Z" direction or "Z-lay" means the outer strands are laid in right hand direction around the center strand. According to the invention, the first synthetic fiber strands and the second synthetic fiber strands are preferably laid in opposite directions: When the first synthetic fiber strands are laid in "S" direction, the second synthetic fiber strands are laid in "Z" direction; When the first synthetic fiber strands are laid in "Z" direction, the second synthetic fiber strands are laid in "S" direction.

Lay factor is the ratio of the lay length to the external diameter of the corresponding layer of strands or members in the stranded rope. Herein, lay length (length of lay) is the axial length for one revolution of a strand or member in a layer of a stranded rope.

In the present invention, the core, the first layer and the second layer has a lay factor in a range from 3 to 15, preferably from 5 to 8, and more preferably from 5.5 to 6.5. It is even more preferable that the core has a lowest lay factor, and the first layer has a lower lay factor than the second layer. As an example, the core has a lay factor of 5.5 to 6, the first layer has a lay factor of 6.25 and the second layer has a lay factor of 6.5. The selection of these lay factors gives each layer of the rope near identical load-elongation properties ensuring that all fibers are nearly loaded equally.

According to the invention, the first layer and/or the second layer may be covered with a protective layer. The protective layer can be braided and/or extruded. This would make the synthetic fiber rope easy to handle. This also provides abrasion and snag protection to the synthetic fiber rope.

In addition, the first synthetic fiber strands and the second synthetic fiber strands can be individually covered with a braided or extruded layer.

Alternatively, the first synthetic fiber strands and the second synthetic fiber strands are not individually covered with a braided or extruded layer. This can minimise void spaces and optimum fiber density. This design has a higher packing factor than the design with strands individually covered. In traditional wire rope constructions, each additional layer has six more strands than the layer below, so that nesting provides optimum fiber density, e.g. 1-6-12-18 construction. The invention construction does not follow this approach. Eliminating the need for nesting allows lay length and number of strands in outer layer to be independent of inner layer. Numbers of strands need not be multiple of previous layer and/or multiple of six. For instance, in the present invention the second layer could contain twenty strands while the first layer contains six strands. This in turn improves the torque/turn response of the design (and the possibility for optimisation), particularly the non-linear response from constructional stretch in bedding process. In this respect, nesting is a negative requirement of historical designs and not necessary in the invention construction.

Synthetic yarns that may be used in the synthetic fiber rope according to the invention include all yarns, which are known for their use in fully synthetic ropes. Such yarns may include yarns made of fibers of polypropylene, nylon, polyester. Preferably, yarns of high modulus fibers or blended high modulus synthetic fibers are used, for example yarns of fibers of ultra-high molecular weight polyethylene (UHMwPE or UHMPE) such as Dyneema® or Spectra®, high molecular weight polyethylene (HMwPE or HMPE), aramid such as poly(p-phenylene terephthalamide) (PPTA, known as Kevlar® and Twaron®), co-poly-(paraphenylene/3,4'-oxydiphenylene terephthalamide) (known as Technora®), liquid crystal polymer (LCP) and poly(p-phenylene-2,6-benzobisoxazole (PBO). The high modulus fibers preferably have a break strength of at least 2 GPa and tensile modulus preferably above 100 GPa.

Synthetic fibers, i.e. the material used in the synthetic fiber rope can be combined in one or more of the ways below:

i) The two materials are combined during twisting of rope yarns (Rope yarn is multiple flat yarns (supplied from yarn manufacturer) twisted together).

ii) A proportion of the rope yarns are replaced during stranding with identically sized rope yarns of alternate material.

iii) A king yarn of different material may be included in the strand. King yarn is the rope yarn at the centre of a strand.

iv) Layers of rope are of different materials.

As an example synthetic fiber rope, at least one of the core, the first layer or the second layer comprises two different high modulus synthetic fibers. As another example the core, the first layer and the second layer are made from different high modulus synthetic fibers.

In the invention rope constructions, the ropes are made up of strands. The strands are made up of rope yarns, which contain synthetic fibers. In the present invention, preferably a synthetic fiber filament has a diameter in the range of 10 to 30 μm, a rope yarn has a diameter in the range of 0.1 mm to 4 mm, a strand has a diameter in the range of 4 mm to 10 mm, and a rope has a diameter more than 10 mm. Methods of forming yarns from fiber, strands from yarn and ropes from strands are known in the art. Strands themselves may also have a plaited, braided, laid, twisted or parallel construction, or a combination thereof. In the invention, preferably at least one of the first synthetic fiber strands and the second synthetic fiber strands in the invention is made from twisted yarns and comprises two or three layers or more of rope yarns. More preferably, all the first synthetic fiber strands and all the second synthetic fiber strands are twisted rope yarn strands. Such a strand is made up of multiple rope yarns stranded around a king rope yarn or inner layer of strand. Most preferably, the two or three layers of laid yarn are laid in different directions, e.g. laid in "SZ", "ZS", "SZS" or "ZSZ" directions.

A synthetic rope according to the present invention can be used on winches, cranes and other pulling and hoisting devices e.g. abandonment and recovery (A&R), knuckle boom crane, riser pull in, riser tensioners, drag shovel hoist, anchor lines and deep shaft hoisting drum and friction winding applications. In these applications, particular demands are placed on a rope as it passes over sheaves and pulleys, is wound under tension onto a drum containing multiple layers or is progressively loaded by friction through a traction drive. The design of the present invention enables it to be integrated onto such systems designed for steel wire rope with minimal system modification and reduces internal wear and fretting mechanisms, where duty cycles or tensions are high.

The invention enables synthetic fiber ropes of stranded construction to be manufactured with a combination of various materials and with low and predictable rotation properties, high bending fatigue resistance, high strength and high radial stability and stiffness and in high continuous lengths for the relevant applications (e.g. 5 km or more).

BRIEF DESCRIPTION OF FIGURES IN THE DRAWINGS

The invention will be better understood with reference to the detailed description when considered in conjunction with the non-limiting examples and the accompanying drawings, in which.

MODE(S) FOR CARRYING OUT THE INVENTION

Figure 1:
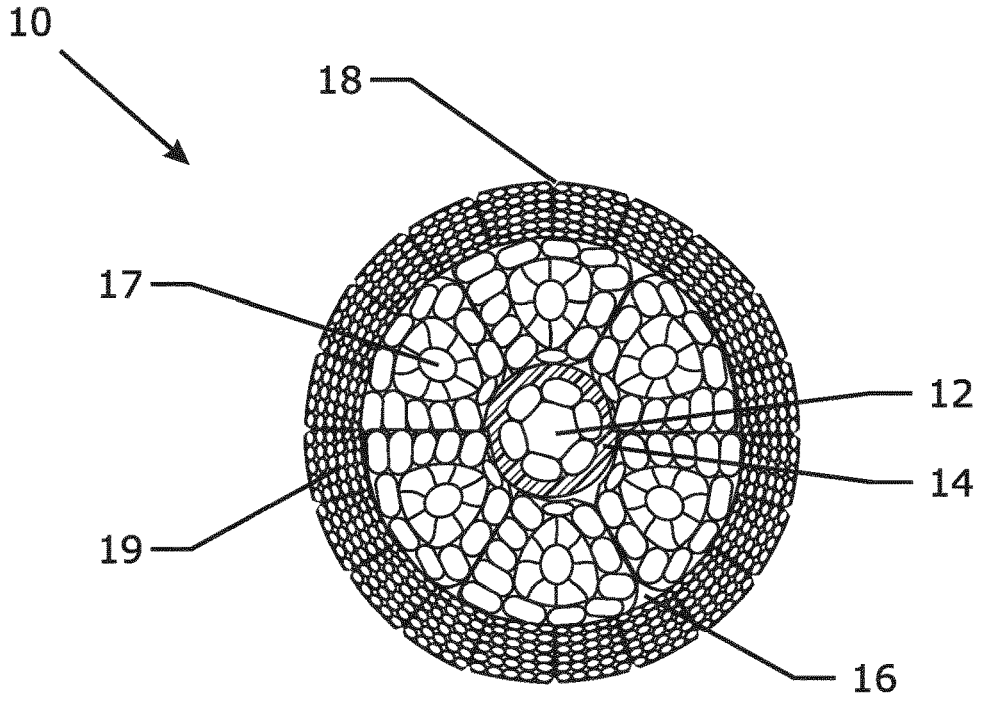
FIG. 1 is a cross-section of a synthetic fiber rope according to a first embodiment of invention.

FIG. 1 is a cross-section of an invention synthetic fiber rope according to a first embodiment. The invention synthetic fiber rope 10 comprises a fiber core 12, an extruded polymer layer 14, a first layer 17 and a second layer 19. The core is a "six-strand", i.e. six strands (core outer) that are closed around a center strand (core inner). The first layer 17 has six first synthetic fiber strands laid in a first direction (closing direction of the first layer) surround said extruded polymer layer 14. The second layer 19 has twenty second synthetic fiber strands laid in a second direction (closing direction of the second layer) surround said first layer 17. The "valleys" 16 between the first synthetic fiber strands and the "valleys" 18 between the second synthetic fiber strands are minimized and are much smaller compared with braided rope constructions.

The extruded polymer layer 14 can be in a tubular formation and can be manufactured from a variety of materials including polypropylene (PP), polyethylene (PE), PP/PE blends, nylon, Hytrel® and Arnitel®.

The lay factors and the closing directions of each layer are shown in table 1 below. In this content, closing direction "A" or "B" refers to either left or right twist directions ("S" or "Z"), and "A" and "B" refer to different twist directions.

TABLE 1

Rope lay factors and closing directions
Rope lay factors and closing direction

| Layer | Lay factor | Closing direction |
|---|---|---|
| Core inner | 5.5 | |
| Core outer | 6 | A |

TABLE 1-continued

| Rope lay factors and closing directions<br>Rope lay factors and closing direction | | |
|---|---|---|
| Layer | Lay factor | Closing direction |
| First layer | 6.25 | B |
| Second layer | 6.5 | A |

Figure 2:
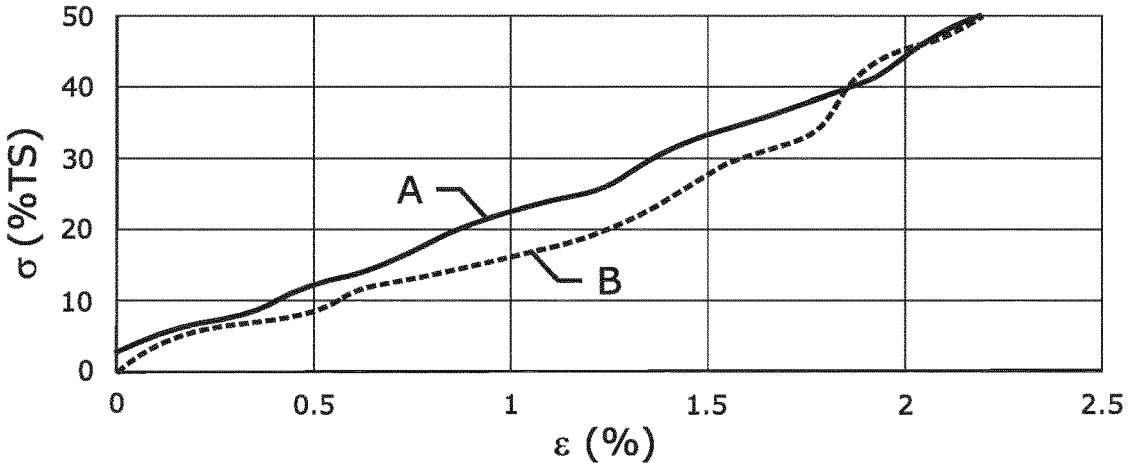
FIG. 2 shows the stress vs. strain relationship of the entire synthetic fiber rope compared with the stress vs. strain relationship of the core and the first layer at the same elongation levels.

FIG. 2 shows the stress of the entire synthetic fiber rope compared with the stress of the core and the first layer at the same elongation levels. The stress σ (% stress a at the Break Load) of the entire synthetic fiber rope as a function of strain ε (%) is indicated by curve A whilst the stress a of the core and the first layer as a function of strain ε (%) is indicated by curve B. As shown in FIG. 2, curve A and curve B present similar stress at the same strain level. It illustrates that the entire rope, the core, the first layer and thus each layer of the rope have similar load-elongation properties. Thanks to the lay factors, all fibres are loaded almost equally whilst also minimising torque and rotation.

Figure 3:
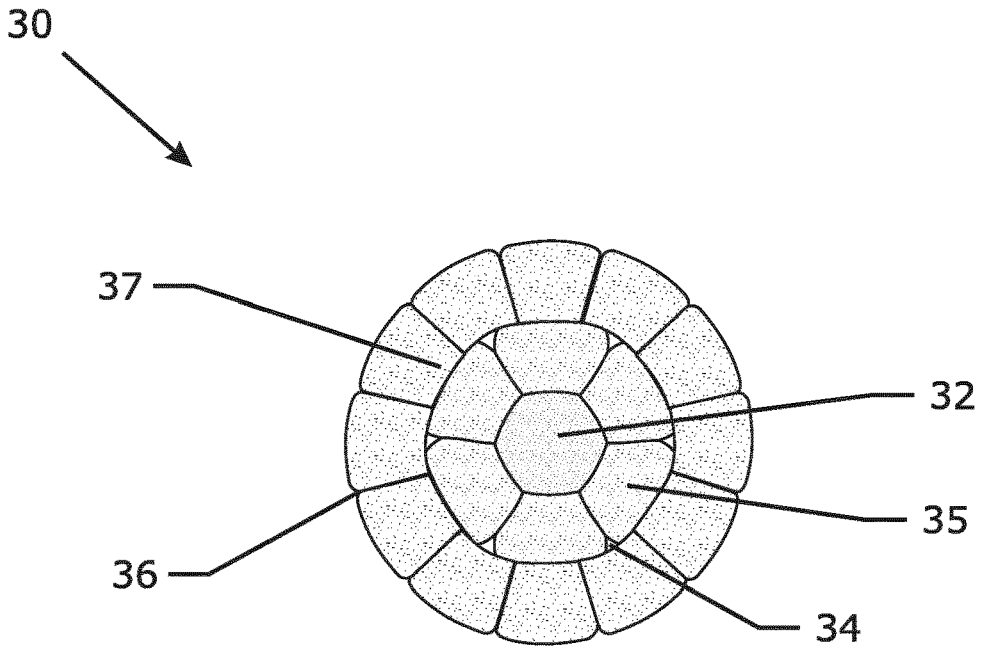
FIG. 3 is a strand construction with three levels/layers.

Here, the first synthetic fiber strands 17 and the second synthetic fiber strands 19 have two or three layers or levels. As shown in FIG. 3, an example strand 30 has three levels: king yarn 32, inner level 34 and outer level 36. Rope yarns 35, 37 in each level 34, 36 are of a single size but need not be the same size in each level 34, 36. The inner level 34 of the strand contains between 20% and 40% of total strand material and the remaining material is distributed around the other part of the strand. Stranding lay factors of each level of a strand and each layer of the synthetic fiber rope are shown in Table 2. Twist directions in each level of the first layer of synthetic fiber rope are shown in Table 3. Twist directions in each level of the second layer of synthetic fiber rope are shown in Table 4.

Each strand can be applied without cover or coating. Alternatively, each strand can also have a protective cover of braided layer or coating/extrusion applied.

TABLE 2

| Stranding lay factors of each level of a stran and each layer of the synthetic fiber rope<br>Stranding lay factors (LF) | | | | |
|---|---|---|---|---|
| Layer | Core inner | Core outer | First layer | Second layer |
| King yarn | 6-10 | 8-12 | 8-12 | 8-12 |
| Inner level | NA | NA | 5-9 | 5-9 |
| Outer level | 5-7 | 7-9 | 7-9 | 7-9 |

Rope yarn may have a lay factor of 15-25 in all layers, except for king yarns which use a lay factor of between 6-10 for the core inner and 8-12 for the core outer, the first layer and second layer.

TABLE 3

| Twist directions in each level of the first layer of synthetic fiber rope | | | | | | |
|---|---|---|---|---|---|---|
| | First layer (Closing direction B) | | | | | |
| Strand | Strand levels opposite direction | | | Strand levels same direction | | |
| position | King yarn | Rope yarn | Strand | King yarn | Rope yarn | Strand |
| Inner | A | B | A | B | A | B |
| Outer | | A | B | | A | B |

TABLE 4

| Twist directions in each level of the second layer of synthetic fiber rope | | | | | | |
|---|---|---|---|---|---|---|
| | Second Layer (Closing direction A) | | | | | |
| Strand | Strand layers opposite direction | | | Strand layers same direction | | |
| posi-tion | King yarn | Rope yarn | Strand | King yarn | Rope yarn | Strand |
| Inner | B | A | B | A | B | A |
| Outer | | B | A | | B | A |

A series of twist directions as shown in table 3 and 4 reduce internal contact angles (increased resistance to internal wear), maximise external wear resistance, reduce torque and rotation characteristics and give optimised strength conversion.

Figure 4:
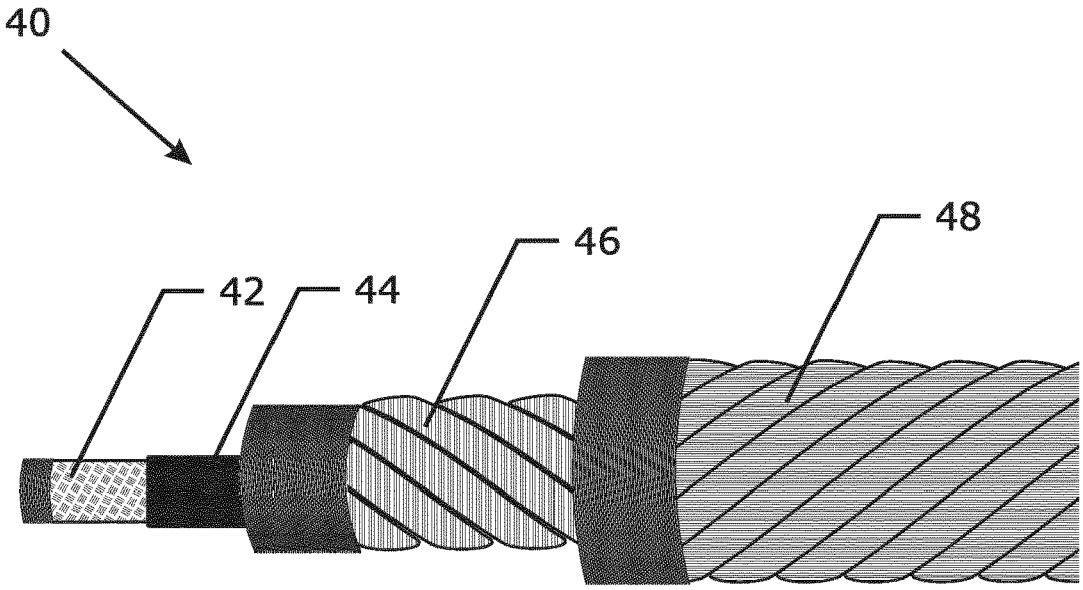
FIG. 4 shows an invention synthetic fiber rope according to a second embodiment of invention.

FIG. 4 shows an invention synthetic fiber rope according to a second embodiment of the invention. The invention synthetic fiber rope 40 comprises a fiber core 42, an extruded polymer layer 44, a first layer 46 and a second layer 48. Different from the above first embodiment, in this embodiment, the fiber core 42 has a braided construction and the extruded polymer layer 44 has a fluted shape. The first layer 46 and the second layer 48 are the same as the above first embodiment.

The invention synthetic fiber rope has a number of features to give the advances in performance with a combination of low and predictable rotation properties, high bending fatigue resistance, high strength and high radial stability and stiffness.

It should be understood that although the present invention has been specifically disclosed by preferred embodiments and optional features, modification and variation of the inventions embodied herein disclosed may be resorted to by those skilled in the art, and that such modifications and variations are considered to be within the scope of this invention.

REFERENCE NUMBERS

10, 40 synthetic fiber rope
12, 42 fiber core
14, 44 extruded polymer layer
17, 46 first layer
16 valley between first synthetic fiber strands
19, 48 second layer
18 valley between second synthetic fiber strands
30 strand
32 king yarn
34 inner level
35, 37 rope yarn
36 outer level

The invention claimed is:

1. A synthetic fiber rope comprising a core, said core being a laid or braided synthetic fiber strand, a polymer layer, said polymer layer covering said core, a first layer, said first layer having at least six first synthetic fiber strands laid in a first direction surround said polymer layer, and a second layer, said second layer having at least twelve second synthetic fiber strands laid in a second direction surround said first layer, wherein said core has cross-sectional area in a range of 5 to 10% relative to a combined cross-sectional area of the polymer layer, the first layer, and the second layer, or said first layer or said second layer has an area in a range of 40 to 60% of the total cross-section area of the synthetic fiber rope.

2. The synthetic fiber rope according to claim 1, wherein each of said core, said first layer and said second layer has a lay factor in a range from 3 to 15.

3. The synthetic fiber rope according to claim 1, wherein said core has a lowest lay factor, and said first layer has a lower lay factor than said second layer.

4. The synthetic fiber rope according to claim 1, wherein said first direction is "S" direction and said second direction is "Z" direction, or said first direction is "Z" direction and said second direction is "S" direction.

5. The synthetic fiber rope according to claim 1, wherein said first layer and/or said second layer are covered with a protective layer.

6. The synthetic fiber rope according to claim 5, wherein said protective layer is braided and/or extruded.

7. The synthetic fiber rope according to claim 1, wherein said first synthetic fiber strands and said second synthetic fiber strands are individually covered with a further layer.

8. The synthetic fiber rope according to claim 1, wherein said first synthetic fiber strands and said second synthetic fiber strands are not individually covered with a further layer.

9. The synthetic fiber rope according to claim 1, wherein at least one of said first synthetic fiber strands and said second synthetic fiber strands is a laid strand and comprises two or three or more layers of rope yarns.

10. The synthetic fiber rope according to claim 9, wherein said two or three layers of the laid yarn are laid in different directions.

11. The synthetic fiber rope according to claim 1, wherein said synthetic fiber rope comprise high modulus synthetic fibers or blended high modulus synthetic fibers selected from the group consisting of ultra-high molecular weight polyethylene (UHMwPE or UHMPE), high molecular weight polyethylene (HMwPE or HMPE), aramid, liquid crystal polymer (LCP), and poly(p-phenylene-2,6-benzobisoxazole (PBO).

12. The synthetic fiber rope according to claim 1, wherein at least one of said core, said first layer or said second layer comprises two different high modulus synthetic fibers.

13. The synthetic fiber rope according to claim 1, wherein said core, is made by different high modulus synthetic fibers from said first layer and said second layer.

* * * * *